United States Patent [19]

Novakovic et al.

[11] Patent Number: 4,963,284

[45] **Date of Patent: * Oct. 16, 1990**

[54] TRANSLUCENT COMBINATION SOAP-SYNTHETIC DETERGENT BAR

[75] Inventors: Mario Novakovic, Kew Garden Hills, N.Y.; Michael A. Esposito, Randolph, N.J.

[73] Assignee: Finetex, Inc., Elmwood Park, N.J.

[ * ] Notice: The portion of the term of this patent subsequent to Jul. 25, 2006 has been disclaimed.

[21] Appl. No.: 310,057

[22] Filed: Feb. 10, 1989

Related U.S. Application Data

[63] Continuation-in-part of Ser. No. 19,358, Feb. 26, 1987, Pat. No. 4,851,147.

[51] Int. Cl.[5] ..... C11D 9/26

[52] U.S. Cl. ..... 252/108; 252/118; 252/121; 252/132; 252/DIG. 16

[58] Field of Search ..... 252/108, 132, 118, DIG. 16, 252/121

[56] References Cited

U.S. PATENT DOCUMENTS 4,490,280 9/1982 Joshi ..... 252/368
4,851,147 2/1989 Esposito et al. ..... 252/108

*Primary Examiner*—John F. Niebling
*Assistant Examiner*—Isabelle R. McAndrews
*Attorney, Agent, or Firm*—Weingram & Zall

[57] ABSTRACT

A machinable translucent combo bar comprising a fatty acid soap, a water soluble synthetic organic detergent and a translucency enhancing amount of a lower alkanol mono-amine for a fatty acid.

25 Claims, No Drawings

TRANSLUCENT COMBINATION SOAP-SYNTHETIC DETERGENT BAR

RELATED APPLICATIONS

This application is a continuation-in-part of U.S. Ser. No. 07/019,358, filed Feb. 26, 1987, now U.S. Pat. No. 4,851,147, the entire disclosure of which is incorporated herein by reference.

BACKGROUND OF THE INVENTION

1. Field of the Invention

This invention relates to translucent soap bars and methods for production thereof. More particularly, this invention relates to making milled or machine finished, translucent soap bars which contain synthetic detergents, i.e., "combo-bars".

2. Prior Art

Transparent soap bars (the ultimate translucent soap bar), and methods for their manufacture, have been known for many years. Being costly to manufacture, they have been generally regarded as luxury items, and their properties have been equated with high purity and neutrality (although they may actually contain free alkali or free fatty acids). Such products have been used almost exclusively for toilet articles, i.e., bathing, hand, and face washing soaps, etc.

Numerous transparent soaps have been formulated. A classic method involves the low temperature saponification of fats and oils predissolved in warm alcohol, water, and glycerine, followed by evaporation of part of the alcohol/water azeotrope. Another common technique is based upon the addition of a polyhydric alcohol, such as glycerol, glycol, sugar or the like to a "neat soap" or semi-boiled soap, or to soap prepared by the cold process technique. Still another method consists of dissolving soap in alcohol to solubilize certain components and then distilling off most of the alcohol.

U.S. Pat. No. 3,562,167 to Kamen describes a transparent soap formed from a combination of soap, polyhydric alcohol, and as a surface-active agent, a polyalkoxy ether of an alkylphenol.

U.S. Pat. No. 3,903,008 to Deweever et al. describes the formulation of a transparent soap by the combination of soap, polyhydric alcohols, and a quaternized dihydroimidazole detergent.

U.S. Pat. Nos. 3,793,214 and 3,926,828 to O'Neil et al. describes transparent soaps produced using branched chain fatty acids. U.S. Pat. No. 3,864,272 to Toma et al. describes the use of a rather complicated, elaborate mechanical method of working the soap, i.e., spray drying followed by mechanical working.

A method of formulating a transparent soap is disclosed in U.S. Pat. No. 2,820,768 where a sodium soap made from tallow, coconut oil, and caster is mixed with a triethanolamine soap of stearic acid and oleic acid and an excess of the amine.

U.S. Pat. No. 4,290,904 to Poper et al describes a transparent low alkalinity bar soap based on a tetrakis (hydroxyalkyl) ethylene diamine.

One of the disadvantages of these prior art transparent soap bars is that they form a scum in hard water. In order to overcome this problem with soaps, not only in transparent soaps, synthetic detergents were developed. It has been found, however, that when these synthetic detergents are added to the typical transparent soap to form what is called a "combo-bar" (i.e., a combination of synthetic detergent and soap), that the bar is no longer transparent. To the Inventors' knowledge, no one to date has made a transparent bar using a synthetic detergent and a soap having the enhanced transparency, clarity, color, and purity of the soaps as described and claimed in Applicant's parent application, U.S.S.N. Ser. No. 07/019,358, now U.S. Pat. No. 4,851,147 nor has anyone used the solubilization system described and claimed therein for cosmetic ingredients.

Additionally, to the inventors' knowledge, no one to date has made a translucent, milled or machine finished, or extruded bar using a synthetic detergent and a soap having the enhanced translucency and enhanced gritlessness of the soaps described and claimed herein.

Further, U.S. Pat. No. 3,741,911 to Shane described certain alkyl-aryl polyoxyalkylene carboxylic acids and derivatives thereof for use as a surfactant in detergent compositions. The entire disclosure of this patent is incorporated herein by reference.

Applicant has discovered that when certain alkanolamines, preferably when used in conjunction with these alkyl-aryl polyoxyalkylene carboxylic acids and preferably utilized in conjunction with a combination of a synthetic detergent and a soap that, surprisingly and unexpectedly, a translucent milled "combo-bar" may be produced.

OBJECTS AND SUMMARY OF THE INVENTION

It is an object of this invention to provide a milled or machine finished "combo-bar" which is translucent.

It is a further object of this invention to produce a translucent, milled or machine finished soap bar, in particular a "combo-bar" having enhanced translucency.

It is still a further object of this invention to provide methods for the preparation of such translucent, milled "combo-bars", by both continuous and batch processes.

Other objects and advantages will be apparent from the following detailed description of the invention.

The invention is directed to a translucent soap bar comprising a fatty acid soap, a water soluble synthetic organic detergent, and a translucency enhancing amount of a lower alkanol mono-amine.

The invention is further directed to a translucent combo bar having a water soluble synthetic organic detergent therein comprising, by weight:

(a) a fatty acid soap, about 40% to about 95%; and (b) a water soluble synthetic organic detergent, about 1% to 25%;

(c) a lower akanol mono-amine about 1% to 10%;

(d) an alkyl-aryl polyoxyalkylene carboxylic acid of the formula:

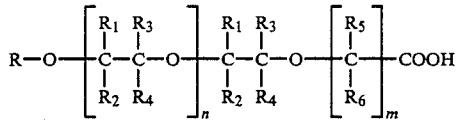

wherein R is either an aryl, alkyl-aryl, or an alkyl radical, preferably alkyl-aryl, $R_1$ through $R_6$ are each hydrogen or a lower alkyl radical and may be the same or different (preferably all are hydrogen) and m is 1 to 3 and n is 1 to 9, about 0% to 10%;

(e) a polyhydrophilic compound, about 0% to 10%; and (f) water up to 25%.

This invention is further directed to a method of enhancing the translucency of a milled or machined "combo-bar", i.e., a bar containing soap and a water soluble synthetic detergent, comprising incorporating in said bar a translucency enhancing amount of a lower alkanol mono-amine.

The invention is also directed to batch or continuous methods of producing said translucent combo bar.

DETAILED DESCRIPTION OF THE INVENTION

The terminology "transparent" as used herein and applied to soap bars refers to a standard described by F. W. Wells in Soap and Chemical Specialties, Vol. XXI, No. 6 and No. 7, Jun. and Jul. 1955. A soap to be considered transparent must permit bold faced type of about 14 point size to be read easily through a quarter-inch section of the soap. Other methods, for example, "translucency voltage", have been employed to evaluate the transparency and translucency of soaps, see for example, U.S. Pat. No. 2,970,116 to Kelly, et al., incorporated herein by reference. In actuality, transparency is the limit of translucency wherein no attenuation or loss of transmission of light occurs, and images viewed through a "transparent" material will appear as if the material were not there at all.

In this application, "translucency" is determined by the size type (i.e., point type, Roman) which can be clearly read through a parallel faced 3 millimeter slice of soap to be tested.

Fatty Acid Soap

The translucent bar, i.e., "combo-bar", of this invention includes predominantly a fatty acid soap. Fatty acid soap is produced by reacting a fatty acid and an amount of a saponifying or neutralizing agent. The fatty acid component is preferably an alkaline metal, alkaline earth metal, e.g., magnesium, ammonium, or amine salt of $C_6$–$C_{22}$ fatty acids and mixtures thereof and may include up to 25% moisture.

The fatty acids employed in making the soaps herein may contain about 6 to 22 or more, preferably, about 8 to 18 carbon atoms, may be of animal, vegetable, or synthetic origin, and may be saturated or unsaturated, and straight, mono- or poly-branched chain hydrocarbon carboxylic acids. As merely illustrative of such acids, there may be mentioned captoic, caprylic, capric, lauric, myristic, stearic, oleic, elaidic, isostearic, palmitic, undecylenic, tridecylenic, pentadecylenic, 2-lower alkyl higher alkanoic or other saturated or unsaturated fatty acids. Dicarboxylic acids may also be used, such as dimerized linoleic acid. Other higher molecular weight acids as rosin or tall oil acid, e.g., abietic acid, may be employed. Readily available commercial blends and mixtures of such blends which may be used include distilled palm and palm kernel oil fatty acids, distilled coconut oil fatty acids, hydrogenated tallow fatty acids, and commercial stearic acid. A preferred fatty acid used is a coco-fatty acid blend of about 45% stearic acid and about 55% palmitic acid, called "a triple pressed acid".

For the saponification of these fatty acids, there may be employed any alkaline metal -, alkaline earth metal -, ammonium- or amine-salt forming base, as for example, sodium, potassium, magnesium, or ammonium hydroxides, mono-, di- or tri-ethanol-, or propanol- amines, or any other such base yielding a water soluble sale or soap of the fatty acid being saponified.

Preferred bases are the lower alkanolamines, in particular triethanolamine and diethanolamine. Another preferred neutralizing agent for such fatty acids is N, N, N', N'-tetrakis (2-hydroxypropyl) ethylenediamine as sold by BASF under the trademark QUADROL, as described in the aforecited U.S. Pat. No. 4,290,904 to Poper et al., the entire disclosure of which is incorporated herein by reference. An approximately stoichiometric amount of base is preferably employed unless a soap is desired containing slight amount of excess fatty acid or base. The precise composition of the soap used to prepare the soap of this invention is not critical as long as the composition does not substantially interfere with the translucency of the final soap product and is typical of those ordinarily employed in the manufacture of toilet soaps, and in particular milled or machined "combo-bars".

The "combo-bar" of this invention is predominantly a fatty acid soap containing up to 95% fatty acid soap and as low as 40% fatty acid soap. Preferably the bar of this invention contains from about 70% to about 85% fatty acid soap.

Synthetic Detergent

The translucent "combo-bar" of this invention contains a water-soluble synthetic organic detergent, typically from about 1% to 25% synthetic detergent. There may be employed many water-soluble synthetic organic detergents, or mixtures thereof, of the anionic sulfonate and sulfate and nonionic aliphatic and aromatic types. Ample descriptions of these "syndets" appear in McCutcheons' "Detergents and Emulsifiers," 1988 Annual, and in "Surface Active Agents" by Schwartz, Perry, and Berch, Vol. II, 1958 (Inter-Science Publishers), which are incorporated herein by reference. Other synthetic detergents are described, for example, in U.S. Pat. No. 4,206,069 to Borrello, also incorporated herein by reference.

Particularly preferred are the water-soluble anionic detergents, in particular the higher (e.g. $C_{10}$–$C_{20}$) acyl sarcosinates, acylisethionates and acyltaurides such as sodium lauroyl sarcosinate, the cocoyl fatty acid ester of isethionic acid, and sodium or potassium N-methyl-N-cocoyl or oleyltaurides. These synthetic detergents contribute improved hard water solubility and improved detergency to the bar of this invention, particularly in hard water. Preferably, they constitute up to about 25% of the "combo-bar" composition and as low as 1% of the "combo-bar," most preferably about 15%. Synthetic detergents which are substantially free of other ingredients or impurities are preferred for producing highly translucent bars. A preferred synthetic detergent is TAURANO I-78, from Finetex, Inc., Elmwood Park, N.J.

Lower Alkanol Mono-amine

An essential element of this invention is the addition of a translucency enhancing amount of a lower alkanol mono-amine. Thus, there may be employed mono-, di- or tri- ethanol-, or propanol- amines. Preferred, lower alkanolamines are triethanolamine and diethanolamine. Other compounds of a basic nature, e.g., sodium and potassium hydroxide, have been used but have not been found to be effective in imparting translucency to a milled "combo-bar." Preferred are from 1% to about 10% with 1% to 4% being highly preferred. It is believed that this essential ingredient functions to form an amine salt with the amphophile which in turn assists in the incorporation of the normally insoluble (in soap) syndet into the soap matrix. The resultant effect is a perceived degree of transparency.

Amphophile

It has also been discovered that a preferred ingredient in enhancing the translucency of the 37 combo-bar" of this invention is the use of an amphophile, preferably an alkyl-aryl polyoxyalkylene carboxylic acid of the formula:

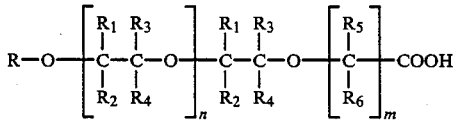

wherein R is either an aryl, alkyl-aryl or alkyl radical, $R_1$ through $R_6$ are each hydrogen or a lower alkyl radical and may be the same or different, m is 1 to 3 and n is 1 to 9, present at about 1% to 10% in the transparent bar. Preferably this compound is present in the range of 1% to 5% and most preferably about 3 to 5% of the transparent combo bar.

This amphophile serves to assist in the incorporation of the "syndet" into the fatty acid soap. The preferred compound of use is SURFINE AZI-A as sold by Finetex, Inc., which is a poly(oxy 1,2 ethandiyl) alpha-nonylphenol-omega-methyl carboxylic acid having the CTFA name of Nonoxynol-10-Carboxylic Acid and having the formula:

$$CH_3—(CH_2)_8—\phi—O\ (CH_2CH_2O)_9—CH_2COOH$$

Note: $\phi$ is a phenyl substituent.

It has been found that when this composition is used in a "combo-bar", it produces a more translucent bar than without.

Additionally, certain other amphophiles, e.g., TAURANOL WS (Sodium Methyl Taurate) from Finetex, Inc., may serve as a "syndet" as well as an amphophile.

Polyhydrophile

A portion of the translucent "combo bar" of this invention, i.e., up to about 10% by weight of the bar, may be a polyhydrophile, e.g., a polyol or polyether. The polyhydrophile is used to substantially eliminate the "grit" in the "combo bar" and enables a "gritless" "combo bar" to be produced. By the use of the term "grit", it is meant a composition or structure within the "combo bar" which imparts a rough or "gritty" feel to the bar in use for washing. The polyhydrophile functions by interfering with the crystalline integrity of the solid syndet resulting in smaller particle sizes. By the use of the term "polyhydrophile", it is meant a molecule of substantial hydrophilic character due to a high percentage of ether, hydric, or other hydrophilic moieties. Preferred polyhydrophiles are monohydric or polyhydric alcohols, such as ethyl alcohol or 1,7-heptane-diol, the mono- and polyethylene and -propylene glycols of up to about 4,000 molecular weight, any mono-$C_{1-4}$ alkyl ethers thereof, sorbitol, glycerol, glucose, diglycerol, sucrose, lactose, dextrose, 2-pentanol, 1-butanol, mono-, di- and triethanolamine, 2-amino-1-butanol, and the like. The translucent bars of this invention may contain a combination of polyhyrophiles, such as glycerine, propylene glycol, or 1,3-butylene glycol, in combination with a sugar, such as sorbitol, glucose, sucrose. It is particularly preferred to use sorbitol, the preferred amount being from about 0% to about 10%.

Other Ingredients

The final bar of this invention will usually contain about up to about 25% water, and preferably about 10% to 25% water. Additional material such as preservatives, antioxidants, colorants, and perfumes can also be used in their usual proportions and for their usual effect. Ethylenediaminetetraacetic acid, tetra sodium salt, can be used to further enhance translucency. It is theorized that this ingredient chelates interfering metallic ions which contribute to haziness of the "combo bar".

Preferred Soap Bars

A preferred translucent "combo-bar" of this invention is made from about 70% to 85% of a fatty acid soap, about 10% to 20% of sodium cocylisethionate, about 2% to 4% triethanolamine, about 2% to 8% sorbitol, and about 2% to 5% SURFINE AZI, i.e., Nonoxynol-10-Carboxylic Acid.

Process of Manufacture

Numerous well-known methods may be utilized for manufacturing the translucent soap bars of this invention. Preferred batch methods of producing these combo bars comprise admixing all of the components and then extruding and stamping bars therefrom.

Still another batch method of preparing the translucent bars of this invention is:

(i) admixing all components except the fatty acid soap;
(ii) admixing the soap therein; and
(iii) extruding; and
(iv) stamping.

A premix composition may be utilized in the aforedescribed batch process. A preferred premix composition comprises:

(a) a water soluble synthetic organic detergent, about 5 to 20 parts by weight;
(b) a lower alkanol mono-amine, about 1 to about 4 parts, by weight.
(c) an alkyl-aryl polyoxyalkylene carboxylic acid of formula:

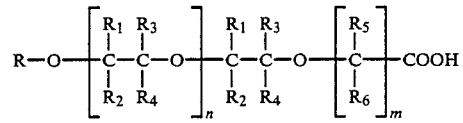

wherein R is an aryl, alkyl-aryl or alkyl radical, $R_1$ through $R_6$ are each hydrogen or a lower alkyl radical and may be the same or different, m is 1 to 3 and n is 1 to 9, about 0 to 4 parts, by weight.

(d) a polyhydric compound about 0 to 8 parts, by weight.

It is also possible to add some of the ingredients during the saponification of the fatty acid soap and others at a latter time, providing the ingredients added do not interfere with the saponification process.

The translucent bar of this invention has unusual translucency, has enhanced stability to light, heat, oxygen, and hard water and has superior foaming qualities. The bar is a low moisture combo bar and has low sloughing and wear rate.

The following examples illustrate the translucent bars of this invention, their process of manufacture and their use thereof. In the foregoing specification and following Examples, unless otherwise indicated, all ingredient proportions are by weight, and when by weight of the bar, it is the finished weight of the bar. All temperatures are in °C.

EXAMPLES

Table I shows experimental milled "combo-bars" made by mixing the fatty acid soap with an admixture of the other ingredients, refining and/or milling, extruding and then stamping into combo bars. The translucency of each bar was measured by taking a 3 millimeter slice of the bar and noting the point size of Roman letters that could be read through the slice. A bar having a reading of 6 points was considered to be translucent, whereas a bar having a reading of 18+ was considered not to be translucent, i.e., opaque.

TABLE I

| Generic Ingredient | Specific Ingredient | Source | By Weight (%) A | B | C | D | E | F | G | H | I | J | K | L |
|---|---|---|---|---|---|---|---|---|---|---|---|---|---|---|
| Fatty acid soap | Soap Base | AVON | QS | QS | QS | QS | QS | QS | QS | QS | QS | QS | QS | QS |
| Syn. det. | TAURANOL I-78 | FTX | 15.0 | 5.0 | 10.0 | 20.0 | 15.0 | 15.0 | 15.0 | 15.0 | 15.0 | 15.0 | 15.0 | 15.0 |
| Amphophilic comp. | SURFINE AZI-A | FTX | 3.0 | 3.0 | 3.0 | 3.0 | 0.0 | 2.0 | 4.0 | 5.0 | | | | |
| Amphophilic comp. | SURFINE WLL-A | FTX | | | | | | | | | 3.0 | | | |
| Amphophilic comp. | SURFINE WNT-A | FTX | | | | | | | | | | 3.0 | | |
| Amphophilic comp. | Sod. Lauryl Sulfate | | | | | | | | | | | | 3.0 | |
| Amphophilic comp. | TAURANOL WS H.P. | | | | | | | | | | | | | 3.0 |
| Amphophilic comp. | GEMTEX SC-75 | | | | | | | | | | | | | |
| Triethanolamine | TEA, 99% | | 2.0 | 2.0 | 2.0 | 2.0 | 2.0 | 2.0 | 2.0 | 2.0 | 2.0 | 2.0 | 2.0 | 2.0 |
| Diethanolamine | DEA | | | | | | | | | | | | | |
| Mono-ethanolamine | MEA | | | | | | | | | | | | | |
| Sodium hydroxide | NaOH | | | | | | | | | | | | | |
| Potassium hydroxide | KOH | | | | | | | | | | | | | |
| Polyhydrophile | Sorbitol (70%) | | 6.0 | | | | | | 6.0 | 6.0 | 6.0 | 6.0 | 6.0 | 6.0 |
| Polyhydrophile | IGEPAL CO630 | | | | | | | | | | | | | |
| Polyhydrophile | TWEEN 20 | | | | | | | | | | | | | |
| Polyhydrophile | GLYCERETH 7 | | | | | | | | | | | | | |
| | Point type (3 mm slice) | | 6 | 18 | 18+ | 11 | 7 | 11 | 8 | — | 6 | 8 | 10 | 6 |

| Generic Ingredient | Specific Ingredient | Source | By Weight (%) M | N | O | P | Q | R | R[1] | S | T | V | W |
|---|---|---|---|---|---|---|---|---|---|---|---|---|---|
| Fatty acid soap | Soap Base | AVON | QS | QS | QS | QS | QS | QS | QS | QS | QS | QS | QS |
| Syn. det. | TAURANOL I-78 | FTX | 15.0 | 15.0 | 15.0 | 15.0 | 15.0 | 15.0 | 15.0 | 15.0 | 15.0 | 15.0 | 15.0 |
| Amphophilic comp. | SURFINE AZI-A | FTX | 3.0 | 3.0 | 3.0 | 3.0 | 3.0 | 3.0 | 0 | 3.0 | 3.0 | 3.0 | 3.0 |
| Amphophilic comp. | SURFINE WLL-A | FTX | | | | | | | | | | | |
| Amphophilic comp. | SURFINE WNT-A | FTX | | | | | | | | | | | |
| Amphophilic comp. | Sod. Lauryl Sulfate | | | | | | | | | | | | |
| Amphophilic comp. | TAURANOL WS H.P. | | | | | | | | | | | | |
| Amphophilic comp. | GEMTEX SC-75 | | | | | | | | | | | 6.0 | |
| Triethanolamine | TEA, 99% | | | | | | 2.0 | 2.0 | 2.0 | 2.0 | 2.0 | 2.0 | 1.0 |
| Diethanolamine | DEA | | 1.41/2.3* | | | | | | | | | | |
| Mono-ethanolamine | MEA | | | 0.8/2.4* | | | | | | | | | |
| Sodium hydroxide | NaOH | | | | 0.5 | | | | | | | | |
| Potassium hydroxide | KOH | | | | | 0.48 | | | | | | | |
| Polyhydrophile | Sorbitol (70%) | | 6.0 | 6.0 | 6.0 | 6.0 | 6.0 | 0 | 6.0 | 6.0 | 6.0 | 6.0 | 6.0 |
| Polyhydrophile | IGEPAL CO630 | | | | | | | 4.2 | 3.0 | | | | |
| Polyhydrophile | TWEEN 20 | | | | | | | | | | | | |
| Polyhydrophile | GLYCERETH 7 | | | | | | | | | | | | |
| | Point type (3 mm slice) | | 11/18+ | 14/14 | 18+ | | | 6 | 11 | — | — | 10 | 6 |

| Generic Ingredient | Specific Ingredient | Source | By Weight (%) X | Y | Z | AA | BB |
|---|---|---|---|---|---|---|---|
| Fatty acid soap | Soap Base | AVON | QS | QS | QS | QS | QS |
| Syn. det. | TAURANOL I-78 | FTX | 15.0 | 15.0 | 15.0 | 15.0 | 15.0 |
| Amphophilic comp. | SURFINE AZI-A | FTX | 3.0 | 3.0 | 3.0 | 3.0 | 3.0 |
| Amphophilic comp. | SURFINE WLL-A | FTX | | | | | |
| Amphophilic comp. | SURFINE WNT-A | FTX | | | | | |
| Amphophilic comp. | Sod. Lauryl Sulfate | | | | | | |
| Amphophilic comp. | TAURANOL WS H.P. | | | | | | |
| Amphophilic comp. | GEMTEX SC-75 | | | | | | |
| Triethanolamine | TEA, 99% | | 4.0 | 5.0 | | | |
| Diethanolamine | DEA | | | | | | |
| Mono-ethanolamine | MEA | | | | | | |
| Sodium hydroxide | NaOH | | | | | | |
| Potassium hydroxide | KOH | | | | | | |
| Polyhydrophile | Sorbitol (70%) | | 6.0 | 6.0 | 6.0 | P Glycol[h] | 1,3/BG[i] |
| Polyhydrophile | IGEPAL CO630 | | | | | | |
| Polyhydrophile | TWEEN 20 | | | | | | |
| Polyhydrophile | GLYCERETH 7 | | | | | | |

TABLE I-continued

| Point type | 8 | — | — | 7 | 6 |
|---|---|---|---|---|---|

Footnotes:
*mol weight/stoichiometric equivalents
[h]propylene glycol
[i]1,3 butylene glycol

Nomenclature

TAURANOL I-78, Finetex, Inc., Elmwood Park, N.J., is a synthetic organic detergent which is Sodium Cocoyl Isethionate of the formula:

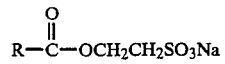

wherein R = cocoyl.

SURFINE AZl-A, Finetex, Inc., Elmwood Park, N.J., is an amphophilic compound which is a Nonoxynol-10 Carboxylic Acid of the formula:

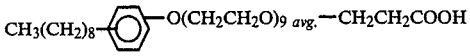

SURFINE WLL-A, Finetex, Inc., Elmwood Park, N.J., is an amphophile which is Sodium Laureth -13 Carboxylate of the formula:

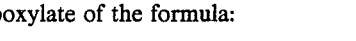

wherein R is lauryl SURFINE WNT-A, Finetex, Inc., Elmwood Park, N.J., is an amphophile compound which is Sodium C12–15 Pareth-7 Carboxylate, of the formula:

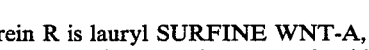

wherein R = $C_{12}$–$C_{15}$ saturated alkyl.

SODIUM LAURYL SULFATE has the formula R—$OSO_3N$ wherein R is lauryl ($C_{12}H_{25}$).

TAURANOL WS H.P., Finetex, Inc., Elmwood Park, N.J., is a high purity form of Sodium N-Methyl Cocoyl Taurate (Tauride) of the formula:

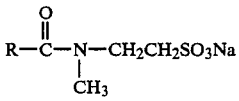

wherein R is Cocyl.

GEMTEX SC-75, Finetex, Inc., Elmwood Park, N.J., is Sodium Dioctyl Sulfosuccinate of the formula:

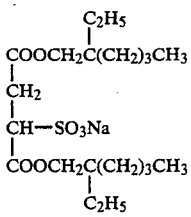

SORBITOL (70%) is a polyhydrophile consisting of 70% solution of water and sorbitol ($C_5H_{14}O_6$—$\frac{1}{4}H_2O$).

IGEPAL C0630, GAF, Inc., Wayne, N.J., is

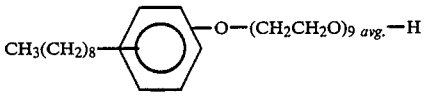

TWEEN 20, ICI, Inc., Wilmington, Del., Sorbitan Monolaurate Polyoxalkylene derivative.

GLYCERETH 7 mole ethylene adduct of glycerine.

Conclusions

1. A lower alkanol mono-amine is required to enhance translucency, with triethanolamine preferred.

2. SURFINE AZI-A is the preferred amphophilic compound and preferred for outstanding translucency, e.g., less than 8 point type.

3. 15% TAURANOL I-78, an organic synthetic detergent, is preferred for outstanding translucency.

4. Triethanolamine is preferred over other lower alkanol mono-amines. Sodium and potassium hydroxides are not useful for enhancing translucency.

What is claimed is:

1. A translucent combo bar comprising a fatty acid soap, a water soluble synthetic organic detergent and a translucency enhancing amount of a lower alkanol mono-amine.

2. The combo bar of claim 1, further comprising a translucency enhancing amount of an amphophilic compound.

3. The combo bar of claim further comprising a grit decreasing amount of a polyhydrophilic compound.

4. The combo bar of claim 1, wherein the mono-amine is triethanolamine.

5. The combo bar of claim 1, wherein the mono-amine is diethanolamine.

6. The combo bar of claim 2, wherein the amphophilic compound is an alkyl-aryl polyoxyalkylene carboxylic acid of the formula:

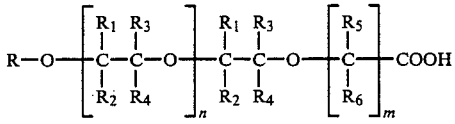

wherein R is an aryl, alkyl-aryl or alkyl radical, $R_1$ through $R_6$ are each hydrogen or a lower alkyl radical and may be the same or different, m is 1 to 3 and n is 1 to 9, about 0% to 10%.

7. The combo bar of claim 3, wherein the polyhydrophilic compound is sorbitol.

8. A translucent combo bar containing soap and a water soluble synthetic detergent comprising:

(a) a fatty acid soap, about 40% to about 95%;

(b) the water soluble synthetic organic detergent, about 1 to 25%;

(c) a lower alkanol mono-amine, about 1% to about 10%;

(d) an alkyl-aryl polyoxyalkylene carboxylic acid of formula:

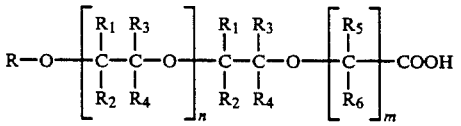

wherein R is an aryl, alkyl-aryl or alkyl radical, $R_1$ through $R_6$ are each hydrogen or a lower alkyl radical and may be the same or different, m is 1 to 3 and n is 1 to 9, about 0% to 10%;

(e) a polyhydrophilic compound 0 to 10%;

(f) water, about 5 to 25%.

9. The combo bar of claim 8 wherein component (e) is propylene glycol, or 1,3 butylene glycol or sorbitol.

10. The combo bar of claim 8, wherein component (e) is sorbitol.

11. The combo bar of claim 8, wherein component (d) is poly(oxy 1,2 ethandiyl)alpha-nonylphenyl omega-methyl carboxylic acid.

12. The combo bar of claim 8, wherein component (a) is sodium cocoyl isethionate.

13. The combo bar of claim 8, wherein component (c) is triethanolamine.

14. A process of making the combo bar of claim 8 comprising admixing component (a) through (f) and then extruding and stamping said admixture.

15. A method of enhancing the translucency of a combo bar containing soap and a water soluble synthetic detergent comprising incorporating in said combo bar a translucency enhancing amount of a lower alkanol mono-amine.

16. The method of claim 15, further comprising incorporating therein a translucency enhancing amount of an alkyl-aryl polyoxyalkylene carboxylic acid of the formula:

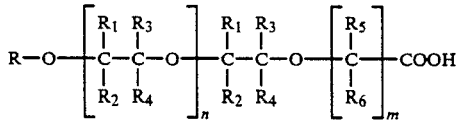

wherein R is an aryl, alkyl-aryl or alkyl radical, $R_1$ through $R_6$ are each hydrogen or a lower alkyl radical and may be the same or different, m is 1 to 3 and n is 1 to 9.

17. The method of claim 16, wherein the alkyl-aryl polyoxyalkylene carboxylic acid is poly(oxy 1,2 ethandiyl) alpha nonylphenyl omega-methyl carboxylic acid.

18. The method of claim 15, wherein the mono-amine is triethanolamine.

19. A premix composition comprising:

(a) a water soluble synthetic organic detergent, about 5 to 20 parts by weight;

(b) a lower alkanol mono-amine, about 1 to about 4 parts, by weight.

(c) an alkyl-aryl polyoxyalkylene carboxylic acid of formula:

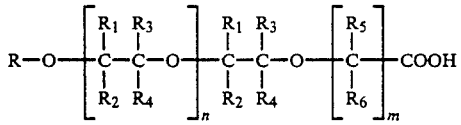

wherein R is an aryl, alkyl-aryl or alkyl radical, $R_1$ through $R_6$ are each hydrogen or a lower alkyl radical and may be the same or different, m is 1 to 3 and n is 1 to 9, about 0 to 4 parts, by weight.

(d) a polyhydric compound about 0 to 8 parts, by weight.

20. A process for producing a translucent combo bar containing soap and a water soluble synthetic detergent comprising:

(a) a fatty acid soap, about 40% to about 95%;

(b) the water soluble synthetic organic detergent, about 1 to 25%;

(c) a lower alkanol mono-amine a translucency enhancing amount of about 10 %;

(d) an alkyl-aryl polyoxyalkylene carboxylic acid of formula:

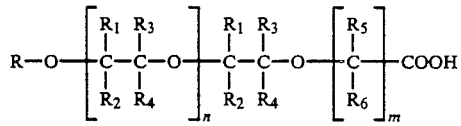

wherein R is an aryl, alkyl-aryl or alkyl radical, $R_1$ through $R_6$ are each hydrogen or a lower alkyl radical and may be the same or different, m is 1 to 3 and n is to 9, about 1% to 10%;

(e) a polyhydrophilic compound 0 to 10%;

(f) water, about 5 to 25%; said process comprising:

(i) admixing components (b) through (f);

(ii) admixing component (a) therein;

(iii) extruding; and (iv) stamping.

21. The combo bar of claim 8,9,10,11,12, or 13, wherein the combo bar contains about 70% to 85% fatty acid soap.

22. The combo bar of claim 8,9,10,1,12, or 13, wherein the combo bar contains about 1% to about 4% of a lower alkanol monoamine.

23. The combo bar of claim 8,9,10,11,12, or 13, wherein the combo bar contains from about 1% to 10% of the carboxylic acid.

24. The combo bar of claim 8,9,10,11,12, or 13, wherein the combo bar contains from about 1% to 5% of the carboxylic acid.

25. The combo bar of claim 8,9,10,11,12, or 13, wherein the combo bar contains from about 3% to 5% of the carboxylic acid.

* * * * *